US007286986B2

(12) United States Patent
Talkin

(10) Patent No.: US 7,286,986 B2
(45) Date of Patent: Oct. 23, 2007

(54) METHOD AND APPARATUS FOR SMOOTHING FUNDAMENTAL FREQUENCY DISCONTINUITIES ACROSS SYNTHESIZED SPEECH SEGMENTS

(75) Inventor: David Talkin, Newton, MA (US)

(73) Assignee: Rhetorical Systems Limited (GB)

( * ) Notice: Subject to any disclaimer, the term of this patent is extended or adjusted under 35 U.S.C. 154(b) by 758 days.

(21) Appl. No.: 10/631,956

(22) Filed: Aug. 1, 2003

(65) Prior Publication Data

US 2004/0059568 A1 Mar. 25, 2004

(30) Foreign Application Priority Data

Aug. 2, 2002 (GB) ..... 0218042.0

(51) Int. Cl.
*G10L 13/06* (2006.01)
*G10L 11/04* (2006.01)

(52) U.S. Cl. ..... 704/268; 704/207; 704/258

(58) Field of Classification Search ..... 704/205, 704/203, 268, 263, 277, 267, 258, 260, 276, 704/207
See application file for complete search history.

(56) References Cited

U.S. PATENT DOCUMENTS 6,266,637 B1 * 7/2001 Donovan et al. ..... 704/258
6,829,581 B2 * 12/2004 Meron ..... 704/258
6,950,798 B1 * 9/2005 Beutnagel et al. ..... 704/260
2003/0208355 A1 * 11/2003 Stylianou et al. ..... 704/207

* cited by examiner

*Primary Examiner*—Tālivaldis Ivars Šmits
*Assistant Examiner*—Josiah Hernandez
(74) *Attorney, Agent, or Firm*—Bromberg & Sunstein LLP

(57) ABSTRACT

A method of smoothing fundamental frequency discontinuities at boundaries of concatenated speech segments includes determining, for each speech segment, a beginning fundamental frequency value and an ending fundamental frequency value. The method further includes adjusting the fundamental frequency contour of each of the speech segments according to a linear function calculated for each particular speech segment, and dependent on the beginning and ending fundamental frequency values of the corresponding speech segment. The method calculates the linear function for each speech segment according to a coupled spring model with three springs for each segment. A first spring constant, associated with the first spring and the second spring, is proportional to a duration of voicing in the associated speech segment. A second spring constant, associated with the third spring, models a non-linear restoring force that resists a change in slope of the segment fundamental frequency contour.

32 Claims, 3 Drawing Sheets

METHOD AND APPARATUS FOR SMOOTHING FUNDAMENTAL FREQUENCY DISCONTINUITIES ACROSS SYNTHESIZED SPEECH SEGMENTS

FIELD OF THE INVENTION

The present invention relates to methods and systems for speech processing, and in particular for mitigating the effects of frequency discontinuities that occur when speech segments are concatenated for speech synthesis.

DESCRIPTION OF RELATED ART

Concatenating short segments of pre-recorded speech is a well-known method of synthesizing spoken messages. Telephone companies, for example, have long used this technique to speak numbers or other messages that may change as a result of user inquiry. Newer, more sophisticated systems can synthesize messages with nearly any content by concatenating speech segments of varying length. These systems, referred to herein as "text-to-speech" (TTS) systems, typically include pre-recorded databases of speech segments designed to include all possible sequences of fundamental speech sounds (referred to herein as "phones") of the language to be synthesized. However, it is often necessary to use several short segments from disjoint parts of the database to create a desired utterance. This desired utterance, i.e., the output of the TTS system, is referred to herein as the "target."

Ideally, the original recordings cover not only phone sequences, but also a wide range of variation in the talker's fundamental frequency $F_0$ (also referred to as "pitch"). For databases of practical size, there are typically cases where it is necessary to abut segments which were not originally contiguous, and for which the $F_0$ is discontinuous where the segments join. Although such a discontinuity is almost always noticeable to some extent, it is particularly noticeable when it occurs in the middle of a strongly-voiced region of speech (e.g., vowels).

The change in the fundamental frequency $F_0$ as a function of time (i.e., the $F_0$ contour) in human speech encodes both linguistic information and "para-linguistic" information about the talker's identity, state of mind, regional accent, etc. Speech synthesis systems must preserve the details of the $F_0$ contour if the speech is to sound natural, and if the original talker's identity and affect are to be preserved. Automatic creation of natural-sounding $F_0$ contours from first principles is still a research topic, and no practical systems which sound completely natural have been published. Even less is known about characterizing and synthesizing $F_0$ contours of a particular talker.

Concatenation-based TTS systems that draw segments of arbitrary length from a large database, and that select these segments dynamically as required to synthesize the target utterance, are known in the art as "unit-selection synthesizers." As the source database for such a synthesizer is being built, it is typically labeled to indicate phone, word, phrase and sentence boundaries. The degree of vowel stress, the location of syllable boundaries, and other linguistic information is tabulated for each phone in the database. Measurements are made on the source speech of the energy and $F_0$ as functions of time. All of these data are available during synthesis to aid in the selection of the most appropriate segments to create the target. During synthesis, the text of the target sentence is typically analyzed to determine its syntactic structure, the part of speech of its constituent words, the pronunciation of the words (including vowel stress and syllable boundaries), the location of phrase boundaries, etc. From this analysis of the target, a rough idea of the target $F_0$ contour, the duration of its phones, and the energy in the speech to be synthesized can be estimated.

The purpose of the unit-selection component in the synthesizer is to determine which segments of speech from the database (i.e., the units) should be chosen to create the target. This usually requires some compromise, since for any particular human language, it is not feasible to record in advance all possible combinations of linguistic and acoustic phenomena that may be required to generate an arbitrary target. However, if units can be found that are a good phonetic match, and which come from similar linguistic and acoustic contexts in the database, then a high degree of naturalness can result from their concatenation. On the other hand, if the smoothness of $F_0$ across segment boundaries is not preserved, especially in fully-voiced regions, the otherwise natural sound is disrupted. This is because the human voice is simply not capable of such jumps in $F_0$, and the ear is very sensitive to distortions that can not be "explained" as a consequence of natural voice-production processes. Thus, the compromise involved in unit selection is made more severe by the need to match $F_0$ at segment boundaries. Even with this increased emphasis on $F_0$, it is often impossible to find exact $F_0$ matches. Therefore effectively smoothing $F_0$ across the segment boundaries can benefit the target in two ways. First, the target will sound better as a direct result of the smoothing. Second, the target may also sound better because the unit selection component can relax the $F_0$ continuity constraint, and consequently select units that are more optimal in other respects, such as more accurately matching the syntactic, phrasal or lexical contexts.

A variety of prior art smoothing techniques exist to mitigate discontinuities at segment boundaries. However, all such techniques suffer from one or both of two significant drawbacks. First, simple smoothing across the segment boundary inevitably smoothes other parts of the segments, and tends to reduce natural $F_0$ variations of perceptual importance. Second, smoothing across discontinuities retains local variations in $F_0$ that are still unnatural, or that can be misinterpreted by the listener as a "pitch accent" that can disrupt the emphasis or semantics of the target utterance.

Some aspects of the human voice, including local energy, spectral density, and duration, can be measured easily and unambiguously. On the other hand, the fundamental frequency $F_0$ is due to the vibration of the talker's vocal folds, during the production of voiced speech sounds such as vowels, glides and nasals. The vocal-fold vibrations modulate the air flowing through the talker's glottis. This vibration may or may not be highly regular from one cycle to the next. The tendency to be irregular is greater near the beginning and end of voiced regions. In some cases, there is ambiguity regarding not only the correct value of $F_0$, but also its presence (i.e. whether the sound is voiced or unvoiced). As a result, all methods of measuring $F_0$ incur errors of one sort or another.

SUMMARY OF THE INVENTION

This disclosure describes a general technique embodying the present invention, along with an exemplary implementation, for removing discontinuities in the fundamental frequency across speech segment boundaries, without introducing objectionable changes in the otherwise natural $F_0$ contour of the segments comprising the synthetic utterance. The general technique is applicable to any system that synthesizes speech by concatenating pre-recorded segments, including (but not limited to) general-purpose text-to-speech (TTS) systems, as well as systems designed for specific, limited tasks, such as telephone number recital, weather reporting, talking clocks, etc. All such systems are referred to herein as TTS without limitation to the scope of the invention as defined in the claims.

This disclosure describes a method of adjusting the fundamental frequency $F_0$ of whole segments of speech in a minimally-disruptive way, so that the relative change of $F_0$ within each segment remains very similar to the original recording, while maintaining a continuous $F_0$ across the segment boundaries. In one embodiment, the method includes constraining the $F_0$ adjustment to only be the addition of a linear function (i.e., a straight line of variable offset and slope) to the original $F_0$ contour of the segment. This disclosure further describes a method of choosing a set of linear functions to be added to the segments comprising the synthetic utterance. This method minimizes changes in the slope of the original $F_0$ contour of a segment, and preferentially alters the $F_0$ of short segments over long segments, because such changes are more likely to be more noticeable in the longer segments.

The technique described herein preferably does not introduce smoothing of $F_0$ anywhere except exactly at the segment boundary, and is much less likely to generate false "pitch accents" than prior art alternatives such as global low-pass filtering or local linear interpolation.

The method and system described herein is robust enough to accommodate occasional errors in the measurement of $F_0$, and consists of two primary components. The first component robustly estimates the $F_0$ found in the original source data. The second component generates the correction functions to match this measured $F_0$ across the speech segment boundaries.

According to one aspect, the invention comprises a method of smoothing fundamental frequency discontinuities at boundaries of concatenated speech segments as defined in claim 1. Each speech segment is characterized by a segment fundamental frequency contour and including two or more frames. The method includes determining, for each speech segment, a beginning fundamental frequency value and an ending fundamental frequency value. The method further includes adjusting the fundamental frequency contour of each of the speech segments according to a linear function calculated for each particular speech segment. The parameters characterizing each linear function are selected according to the beginning fundamental frequency value and the ending fundamental frequency value of the corresponding speech segment.

In one embodiment, the predetermined function includes a linear function. In another embodiment, the predetermined function adjusts a slope associated with the speech segment. In another embodiment, the predetermined function adjusts an offset associated with the speech segment.

In another embodiment, the predetermined function calculated for each particular speech segment is dependent upon a length associated with the speech segment, such that the predetermined function adjusts longer segments more than shorter segments. In other words, the longer a segment is, the more significantly the predetermined function adjusts it.

Another embodiment further includes determining several parameters for each speech segment. These parameters may include (i) a total duration of the segment, (ii) a total duration of all voiced regions of the segment, (iii) a average value of the fundamental frequency contour over all voiced regions of the segment, (iv) a median value of the fundamental frequency contour over all voiced regions of the segment, and (v) a standard deviation of the fundamental frequency contour over the whole segment. Combinations of these parameters, or other parameters not listed may also be determined.

Another embodiment further includes setting the determined median value of the fundamental frequency contour over all voiced regions of the segment to the average value of the fundamental frequency contour over all voiced regions of the segment, if a number of fundamental frequency samples in the speech segment is less than a predetermined value (i.e., a threshold).

Another embodiment further includes examining a predetermined number of frames from a beginning point of each speech segment, and setting the beginning fundamental frequency value to a fundamental frequency value of the first frame, if all fundamental frequency values of the predetermined number of frames from the beginning point of the speech segment are within a predetermined range.

Another embodiment further includes examining a predetermined number of frames from a ending point of each speech segment, and setting the ending fundamental frequency value to a fundamental frequency value of the last frame if all fundamental frequency values of the predetermined number of frames from the ending point of the speech segment are within a predetermined range.

Another embodiment further includes setting the beginning fundamental frequency and the ending fundamental frequency of unvoiced speech segments to a value substantially equal to a median value of the fundamental frequency contour over all voiced regions of a preceding voiced segment.

Another embodiment further includes calculating, for each pair of adjacent speech segments n and n+1, (i) a first ratio of the $n^{th}$ ending fundamental frequency value to the $n+1^{th}$ beginning fundamental frequency value, (ii) a second ratio being the inverse of the first ratio, and adjusting the $n^{th}$ ending fundamental frequency value and the $n+1^{th}$ beginning fundamental frequency value, only if the first ratio and the second ratio are less than a predetermined ratio threshold.

Another embodiment further includes calculating the linear function for each individual speech segment according to a coupled spring model.

Another embodiment further includes implementing the coupled spring model such that a first spring component couples the beginning fundamental frequency value to an anchor component, a second spring component couples the ending fundamental frequency value to the anchor component, and a third spring component couples the beginning fundamental frequency value to the ending fundamental frequency value.

Another embodiment further includes associating a spring constant with the first spring and the second spring such that the spring constant is proportional to a duration of voicing in the associated speech segment.

Another embodiment further includes associating a spring constant with the third spring such that the third spring models a non-linear restoring force that resists a change in slope of the segment fundamental frequency contour.

Another embodiment further includes forming a set of simultaneous equations corresponding to the coupled spring models associated with all of the concatenated speech segments, and solving the set of simultaneous equations to produce the parameters characterizing each linear function associated with one of the speech segments.

Another embodiment further includes solving the set of simultaneous equations through an iterative algorithm based on Newton's method of finding zeros of a function.

In another aspect, the invention comprises a system for smoothing fundamental frequency discontinuities at boundaries of concatenated speech segments as defined in claim 18. Each speech segment is characterized by a segment fundamental frequency contour and including two or more frames. The system includes a unit characterization processor for receiving the speech segments and characterizing each segment with respect to the beginning fundamental frequency and the ending fundamental frequency. The system further includes a fundamental frequency adjustment processor for receiving the speech segments, the beginning fundamental frequency and ending fundamental frequency. The fundamental frequency adjustment processor also adjusts the fundamental frequency contour of each of the speech segments according to a linear function calculated for each particular speech segment. The parameters characterizing each linear function are selected according to the beginning fundamental frequency value and the ending fundamental frequency value of the corresponding speech segment.

In another embodiment, the unit characterization processor determines a number of parameters associated with each speech segment. These parameters may include (i) a total duration of the segment, (ii) a total duration of all voiced regions of the segment, (iii) a average value of the fundamental frequency contour over all voiced regions of the segment, (iv) a median value of the fundamental frequency contour over all voiced regions of the segment, and (v) a standard deviation of the fundamental frequency contour over the whole segment. Combinations of these parameters, or other parameters not listed may also be determined.

In another embodiment, the unit characterization processor sets the determined median value of the fundamental frequency contour over all voiced regions of the segment to the average value of the fundamental frequency contour over all voiced regions of the segment, if a number of fundamental frequency samples in the speech segment is less than a predetermined value.

In another embodiment, the unit characterization processor examines a predetermined number of frames from a beginning point of each speech segment, and sets the beginning fundamental frequency value to a fundamental frequency value of the first frame if all fundamental frequency values of the predetermined number of frames from the beginning point of the speech segment are within a predetermined range.

In another embodiment, the unit characterization processor examines a predetermined number of frames from a ending point of each speech segment, and sets the ending fundamental frequency value to a fundamental frequency value of the last frame if all fundamental frequency values of the predetermined number of frames from the ending point of the speech segment are within a predetermined range.

In another embodiment, the unit characterization processor sets the beginning fundamental frequency and the ending fundamental frequency of unvoiced speech segments to a value substantially equal to a median value of the fundamental frequency contour over all voiced regions of a preceding voiced segment.

In another embodiment, the unit characterization processor calculates, for each pair of adjacent speech segments n and n+1, (i) a first ratio of the $n^{th}$ ending fundamental frequency value to the $n+1^{th}$ beginning fundamental frequency value, (ii) a second ratio being the inverse of the first ratio, and adjusts the $n^{th}$ ending fundamental frequency value and the $n+1^{th}$ beginning fundamental frequency value only if the first ratio and the second ratio are less than a predetermined ratio threshold.

In another embodiment, the fundamental frequency adjustment processor calculates the linear function for each individual speech segment according to a coupled spring model.

In another embodiment, the fundamental frequency adjustment processor implements the coupled spring model such that a first spring component couples the beginning fundamental frequency value to an anchor component, a second spring component couples the ending fundamental frequency value to the anchor component, and a third spring component couples the beginning fundamental frequency value to the ending fundamental frequency value.

In another embodiment, the fundamental frequency adjustment processor associates a spring constant with the first spring and the second spring such that the spring constant is proportional to a duration of voicing in the associated speech segment.

In another embodiment, the fundamental frequency adjustment processor associates a spring constant with the third spring such that the third spring models a non-linear restoring force that resists a change in slope of the segment fundamental frequency contour.

In another embodiment, the fundamental frequency adjustment processor forms a set of simultaneous equations corresponding to the coupled spring models associated with all of the concatenated speech segments, and solves the set of simultaneous equations to produce the parameters characterizing each linear function associated with one of the speech segments.

In another embodiment, the fundamental frequency adjustment processor solves the set of simultaneous equations through an iterative algorithm based on Newton's method of finding zeros of a function.

In another aspect, the invention comprises a method of determining, for each of a series of concatenated speech segments, a beginning fundamental frequency value and an ending fundamental frequency value. Each speech segment is characterized by a segment fundamental frequency contour and including two or more frames. The method includes determining a number of parameters associated with each speech segment. These parameters may include (i) a total duration of the segment, (ii) a total duration of all voiced regions of the segment, (iii) a average value of the fundamental frequency contour over all voiced regions of the segment, (iv) a median value of the fundamental frequency contour over all voiced regions of the segment, and (v) a standard deviation of the fundamental frequency contour over the whole segment. The parameters may include combinations thereof, or other parameters not listed. The method further includes setting the median value of the fundamental frequency contour over all voiced regions of the segment to the average value of the fundamental frequency contour over all voiced regions of the segment if a number of fundamental frequency samples in the speech segment is less than a predetermined value. The method further includes examining a predetermined number of frames from a beginning point of each speech segment, and setting the beginning fundamental frequency value to a fundamental frequency value of the first frame if all fundamental frequency values of the predetermined number of frames from the beginning point of the speech segment are within a predetermined range. The method further includes examining a predetermined number of frames from a ending point of each speech segment, and setting the ending fundamental frequency value to a fundamental frequency value of the last frame if all fundamental frequency values of the predetermined number of frames from the ending point of the speech segment are within a predetermined range. The method further includes setting the beginning fundamental frequency and the ending fundamental frequency of unvoiced speech segments to a value substantially equal to a median value of the fundamental frequency contour over all voiced regions of a preceding voiced segment. The method further includes calculating, for each pair of adjacent speech segments n and n+1, (i) a first ratio of the $n^{th}$ ending fundamental frequency value to the $n+1^{th}$ beginning fundamental frequency value, (ii) a second ratio being the inverse of the first ratio, and adjusting the $n^{th}$ ending fundamental frequency value and the $n+1^{th}$ beginning fundamental frequency value only if the first ratio and the second ratio are less than a predetermined ratio threshold.

In another aspect, the invention comprises a method of adjusting a fundamental frequency contour of each of a series of concatenated speech segments according to a linear function calculated for each particular speech segment. The parameters characterizing each linear function are selected according to a beginning fundamental frequency value and an ending fundamental frequency value of the corresponding speech segment. The method includes calculating the linear function for each individual speech segment according to a coupled spring model. The coupled spring model is implemented such that a first spring component couples the beginning fundamental frequency value to an anchor component, a second spring component couples the ending fundamental frequency value to the anchor component, and a third spring component couples the beginning fundamental frequency value to the ending fundamental frequency value. The method further includes forming a set of simultaneous equations corresponding to the coupled spring models associated with all of the concatenated speech segments, and solving the set of simultaneous equations to produce the parameters characterizing each linear function associated with one of the speech segments.

A preferred embodiment provides a method of determining, for each of a series of concatenated speech segments, a beginning fundamental frequency value and an ending fundamental frequency value, each speech segment characterized by a segment fundamental frequency contour and including two or more frames, comprising:

determining, for each speech segment, (i) a total duration of the segment, (ii) a total duration of all voiced regions of the segment, (iii) a average value of the fundamental frequency contour over all voiced regions of the segment, (iv) a median value of the fundamental frequency contour over all voiced regions of the segment, and (v) a standard deviation of the fundamental frequency contour over the whole segment;

setting the median value of the fundamental frequency contour over all voiced regions of the segment to the average value of the fundamental frequency contour over all voiced regions of the segment if a number of fundamental frequency samples in the speech segment is less than a predetermined value;

examining a predetermined number of frames from a beginning point of each speech segment, and setting the beginning fundamental frequency value to a fundamental frequency value of the first frame if all fundamental frequency values of the predetermined number of frames from the beginning point of the speech segment are within a predetermined range;

examining a predetermined number of frames from a ending point of each speech segment, and setting the ending fundamental frequency value to a fundamental frequency value of the last frame if all fundamental frequency values of the predetermined number of frames from the ending point of the speech segment are within a predetermined range;

setting the beginning fundamental frequency and the ending fundamental frequency of unvoiced speech segments to a value substantially equal to a median value of the fundamental frequency contour over all voiced regions of a preceding voiced segment; and, calculating, for each pair of adjacent speech segments n and n+1, (i) a first ratio of the $n^{th}$ ending fundamental frequency value to the $n+1^{th}$ beginning fundamental frequency value, (ii) a second ratio being the inverse of the first ratio, and adjusting the $n^{th}$ ending fundamental frequency value and the $n+1^{th}$ beginning fundamental frequency value only if the first ratio and the second ratio are less than a predetermined ratio threshold.

The preferred embodiment also provides a method of adjusting a fundamental frequency contour of each of a series of concatenated speech segments according to a linear function calculated for each particular speech segment, wherein parameters characterizing each linear function are selected according to a beginning fundamental frequency value and an ending fundamental frequency value of the corresponding speech segment, comprising:

calculating the linear function for each individual speech segment according to a coupled spring model, wherein the coupled spring model is implemented such that a first spring component couples the beginning fundamental frequency value to an anchor component, a second spring component couples the ending fundamental frequency value to the anchor component, and a third spring component couples the beginning fundamental frequency value to the ending fundamental frequency value; and, forming a set of simultaneous equations corresponding to the coupled spring models associated with all of the concatenated speech segments, and solving the set of simultaneous equations to produce the parameters characterizing each linear function associated with one of the speech segments.

There is also provided a preferred system for smoothing fundamental frequency discontinuities at boundaries of concatenated speech segments, each speech segment characterized by a segment fundamental frequency contour and including two or more frames, comprising:

means for determining, for each speech segment, a beginning fundamental frequency value and an ending fundamental frequency value;

means for adjusting the fundamental frequency contour of each of the speech segments according to a linear function calculated for each particular speech segment, wherein parameters characterizing each linear function are selected according to the beginning fundamental frequency value and the ending fundamental frequency value of the corresponding speech segment.

BRIEF DESCRIPTION OF DRAWINGS

The foregoing and other aspects of embodiments of this invention, may be more fully understood from the following description of the preferred embodiments, when read together with the accompanying drawings in which.

DESCRIPTION OF THE PREFERRED EMBODIMENTS

Figure 1:
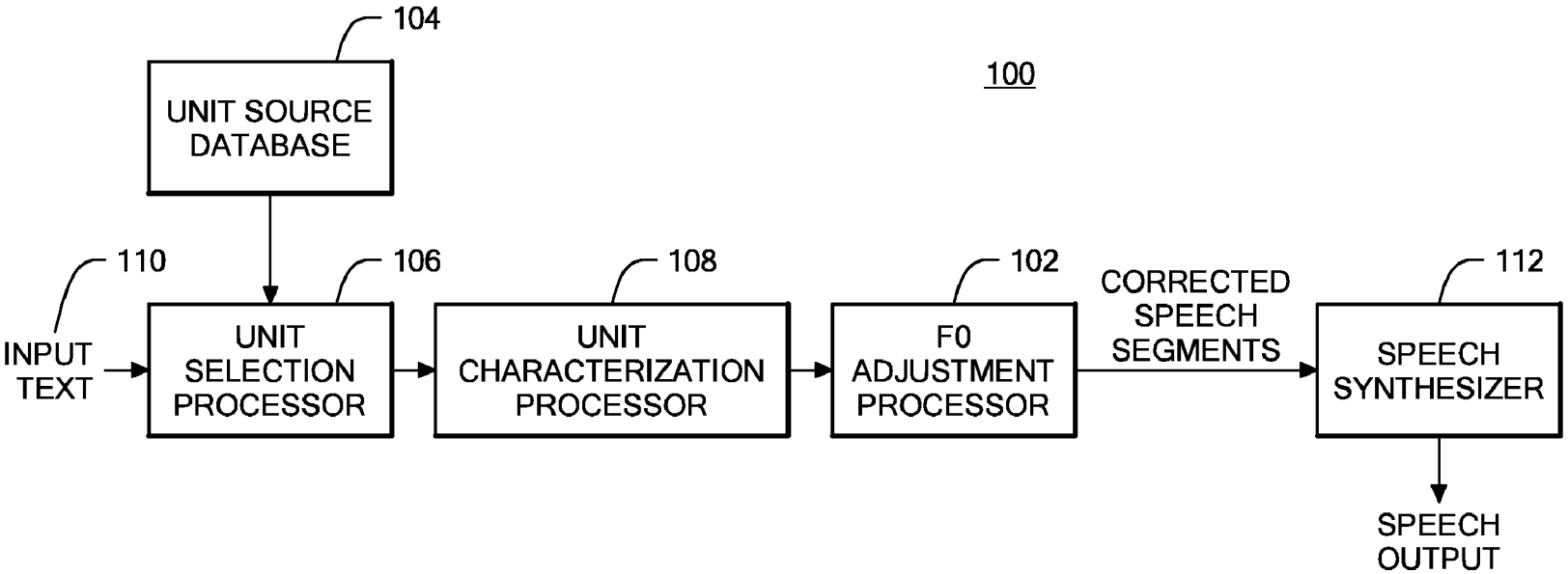
FIG. 1 shows a block diagram view of an embodiment of a $F_0$ adjustment processor for smoothing fundamental frequency discontinuities across synthesized speech segments.

FIG. 1 shows, in the context of a TTS system 100, a block diagram view of one preferred embodiment of a $F_0$ adjustment processor 102 for smoothing fundamental frequency discontinuities across synthesized speech segments. In addition to the $F_0$ adjustment processor 102, the TTS system 100 includes a unit source database 104, a unit selection processor 106, and a unit characterization processor 108. The source database 104 includes speech segments (also referred to as "units" herein) of various lengths, along with associate characterizing data as described in more detail herein. The unit selection processor 106 receives text data 110 to be synthesized and selects appropriate units from the source database 104 corresponding to the text data 110. The unit characterization processor 108 receives the selected speech units from the unit selection processor 106 and further characterizes each unit with respect to endpoint $F_0$ (i.e., beginning fundamental frequency and ending fundamental frequency), and other parameters as described herein. The $F_0$ adjustment processor 102 receives the speech units along with the associated characterization parameters from the characterization processor 108, and adjusts the $F_0$ of each unit as described in more detail herein, so as to match the $F_0$ characteristics at the unit boundaries. The $F_0$ adjustments processor 102 outputs corrected speech segments to a speech synthesizer 112 which generates and outputs speech. Although these components of the TTS system 100 are described conceptually herein as individual processors, it should be understood that this description is exemplary only, and in other embodiments, these components may be implemented in other architectures. For example, all components of the TTS system 100 could be implemented in software running on a single computer system. In other embodiments, the individual components could be implemented completely in hardware (i.e., application specific integrated circuits).

In preparing the source database 104, the $F_0$ and voicing state VS (i.e., one of two possible states: voiced or unvoiced) of all speech units are estimated using any of several $F_0$ tracking algorithms known in the art. One such tracking algorithm is described in "A robust Algorithm for Pitch Tracking (RAPT)," by David Talkin, in "Speech Coding and Synthesis," E. B. Keijn & K. K. Paliwal, eds., Elsevier, 1995. These estimates are used to find the "glottal closure instants" (referred to herein as "GCIs") that occur once per cycle of the $F_0$ during voiced speech, or that occur at periodic locations during the unvoiced speech intervals. The result is, for each speech segment, a series of estimates of the voicing state and $F_0$ at intervals varying between about 2 ms and 33 ms, depending on the local $F_0$. Each estimate, referred to herein as a "frame," may be represented as a two-tuple vector ($F_0$, VS). The majority of these frames will be correct, but as many as 1% may be quite wrong, where the estimated $F_0$ and/or voicing state are completely wrong. If one of these bad estimates is used to determine the correction function, then the result will be seriously degraded synthesis; much worse than would have resulted had no "correction" been applied. It should be further noted, that, since the unit selection process has already attempted to gather segments from mutually-compatible contexts in the source material, it is rare that extreme changes in $F_0$ will be required to effectively smooth across the speech segment boundaries. Finally, the amount of audible degradation in the target due to $F_0$ modification is greater as the variation increases, so that extreme $F_0$ correction may degrade rather than improve the result, even if the relevant $F_0$ estimates are correct.

The following input parameters are provided to and used by the unit characterization processor 108, along with the frames and the associated speech segments, to calculate a number of output parameters:

| | |
|---|---|
| MIN_F0 | The minimum $F_0$ allowed in any part of the system. |
| RISKY_STD | The number of standard deviations in $F_0$ variation between adjacent $F_0$ samples allowed before the measurements are considered suspect. |
| N_ROBUST | The number of $F_0$ samples required in a segment to establish reliable estimates of $F_0$ mean and median. |
| DUR_ROBUST | The duration of a segment required before $F_0$ statistics in the segment can be considered to be reliable. |
| N_F0_CHECK | The number of adjacent $F_0$ measurements near the segment endpoints which must be within RISKY_STD of one another before a single $F_0$ measurement at the endpoint is accepted as the true value of $F_0$. |
| MAX_RATIO | The maximum ratio of $F_0$ estimates in adjacent segments over which smoothing will be attempted. |
| M | The number of frames in the segment. |
| N_F0 | The number of voiced frames contained in a segment. |

Values of these parameters used in the preferred embodiment are:

| | |
|---|---|
| MIN_F0 | 33.0 Hz |
| RISKY_STD | 1.5 |
| N_ROBUST | 5 |
| DUR_ROBUST | 0.06 sec. |
| N_F0_CHECK | 4 |
| MAX_RATIO | 1.8 |

However, less preferred parameters might fall in the following ranges:

| | | | | |
|---|---|---|---|---|
| 20.0 | <= | MIN_F0 | <= | 50.0 Hz |
| 1.0 | <= | RISKY_STD | <= | 2.5 |
| 3 | <= | N_ROBUST | <= | 10 |
| 0.04 | <= | DUR_ROBUST | <= | 0.1 sec |
| 3 | <= | N_F0 CHECK | <= | 10 |
| 1.2 | < | MAX_RATIO | <= | 3.0 |

and these should not limit the scope of the invention as defined in the claims.

The following are the output parameters generated by the characterization processor 108

| | |
|---|---|
| DUR | The duration of the entire segment. |
| V_DUR | The total duration of all voiced regions in the segment. |
| F0_MEAN | Average $F_0$ value over all voiced regions in a segment. |
| F0_MEDIAN | Median $F_0$ value over all voiced regions in a segment. |
| F0_STD | The standard deviation in $F_0$ over the whole segment. |
| F01 | The estimate of $F_0$ at the beginning of a segment (beginning fundamental frequency). |
| F02 | The estimate of $F_0$ at the end of a segment (ending fundamental frequency). |

Figure 2:
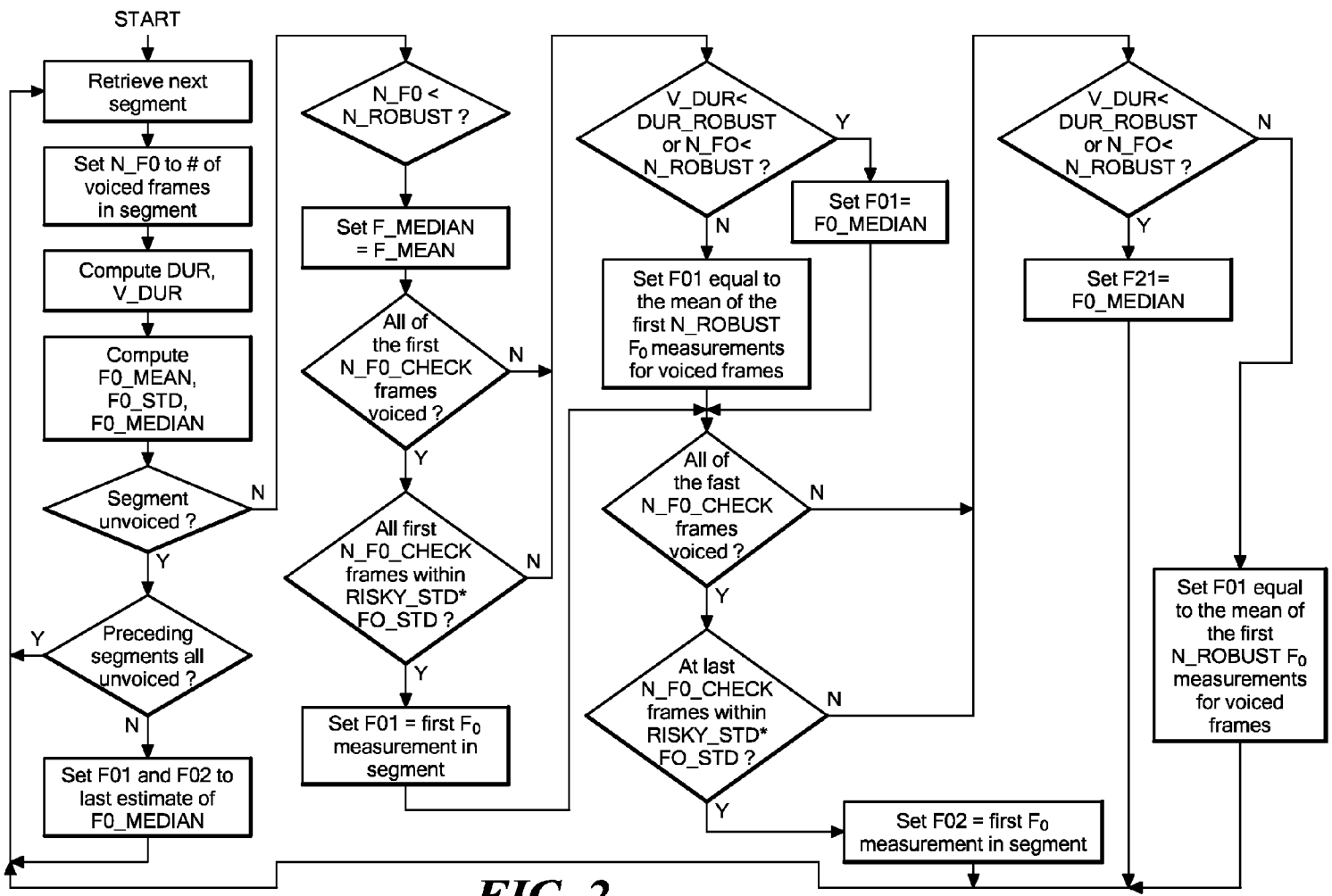
FIG. 2 shows, in flow-diagram form, the steps performed to determine the beginning fundamental frequency and the ending fundamental frequency of the speech segments.

The speech segments (also referred to herein as "units") returned by a typical unit-selection algorithm employed by the unit selection processor 106 may consist of one or many phones, and duration of each segment may vary from 30 ms to several seconds. The method and system described herein is suitable for segments of any length. For each segment to be used in the target utterance, F01 and F02 are estimated by performing the following steps, illustrated in flow-diagram form in FIG. 2:

1. Set 202 N_F0 to the number of voiced frames in the segment.
2. Compute 204 DUR and V_DUR of the segment.
3. Compute 206 F0_MEAN, F0_STD and F0_MEDIAN for the segment.
4. If the segment is unvoiced (N_F0 equals 0) 208, and no other segments preceding it in the target sequence have been voiced 210, skip the remainder of the steps, and proceed to the next segment at step 1.
5. If (N_F0=0) 208, but this segment is preceded by one or more segments containing voicing 210, use the last estimate of F0 _MEDLAN as both F01 and F02 for this segment 214, then go on to the next segment at step 1.
6. If N_F0 is less than N_ROBUST 216, set F0_MEDIAN for the segment to its F0_MEAN 218.
7. Starting at the beginning of the segment, examine the first N_F0_CHECK frames. If they are all voiced 220, and if their $F_0$ measurements all fall within (RISKY_STD* F0_STD) of the following frame's measurement 222, set F01 to the first $F_0$ measurement in the segment 224, then go to step 10, else, go to step 8.
8. If V_DUR is less than DUR_ROBUST or N_F0 is less than N_ROBUST 226, set F01 to F0_MEDIAN for the segment 228, then go to step 10, else go to step 9.
9. Starting at the beginning of the segment, find the first N_ROBUST F0 measurements (voiced frames). Set F01 to the mean of $F_0$ found in these frames 230.
10. Starting at the end (last frame) of the segment, examine the last N_F0_CHECK frames. If they are all voiced 232, and if their $F_0$ measurements all fall within (RISKY_STD*F0_STD) of the preceding frame's measurement 234, set F02 to the last $F_0$ measurement in the segment 236, then go to step 1 for the next segment, else go to step 11.
11. If V_DUR is less than DUR_ROBUST or N_F0 is less than N_ROBUST 238, set F02 to F0_MEDIAN for the segment 240, then go to step 1 for the next segment, else go to step 12.
12. Starting at the end of the segment, find the last N_ROBUST F0 measurements (voiced frames). Set F02 to the mean of $F_0$ found in these frames 242. Go to step 1 for the next segment.

At the end of these steps M, DUR, V_DUR, F01 and F02 are known for all segments comprising the target utterance. These values can be subscripted to indicate their dependence upon the segment, as is shown in the examples herein.

As a final step before actually computing the correction functions, a check is made on the reasonableness of matching F0 across the segment boundaries. If $$\frac{F02(n)}{F01(n+1)} > \text{MAX_RATIO}$$

or $$\frac{F01(n+1)}{F02(n)} > \text{MAX_RATIO},$$

then that boundary is marked to indicate that the $F_0$ endpoint values on either side should be left unchanged. This is useful for two reasons. First, large alterations to $F_0$ will result in unnatural-soundingspeech, even if the estimates for F02(n) and F01(n+1) are reasonable. Second, it is relatively rare that large ratios are encountered, so when one is found, the likely cause is that the $F_0$ tracker has made an error. In both cases, it is prudent to leave these endpoints unchanged.

The next part of the process modifies the $F_0$ of the original speech segments by applying relatively simple correction functions, which are unlikely to significantly alter the prosody of the original material. The term "prosody," as used herein, refers to variations in stress, pitch, and rhythm of speech by which different shades of meaning are conveyed. Using a simple low-pass filter to modify the $F_0$ contours in an attempt to smooth across the boundaries produces two undesirable results. First, some of the natural variation in the speech will be lost. Second, a local variation due to the $F_0$ discontinuity at the segment boundary will still be retained, and will constitute "noise" in the prosody. The method described herein adds simple, linear functions at least or substantially linear functions to the original segment $F_0$ contours to enforce $F_0$ continuity across the joins while retaining the original details of relative $F_0$ variation largely unchanged, except for overall raising or lowering, or the introduction of slight changes in overall slope. The proposed method favors introducing offsets to short segments over long segments, and discourages large changes in overall slope for all segments. We will now describe one possible embodiment of the idea that employs a coupled-spring model to satisfy the constraints.

Figure 3A:
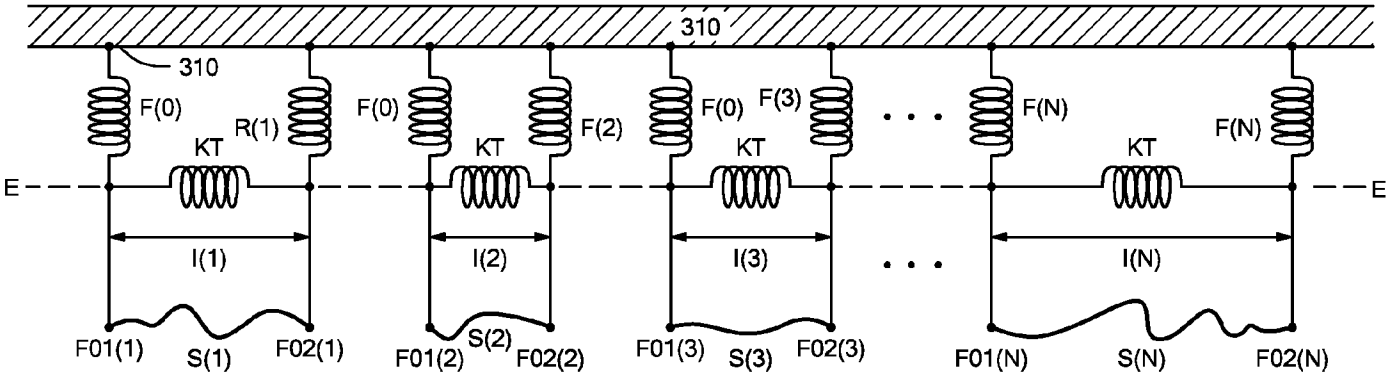
FIG. 3A shows the coupled-spring model according to an embodiment of the present invention prior to adjustments to beginning and ending F0 values; and, FIG. 3B shows the coupled-spring model of FIG. 3A after to adjustments to beginning and ending F0 values.
Figure 3B:
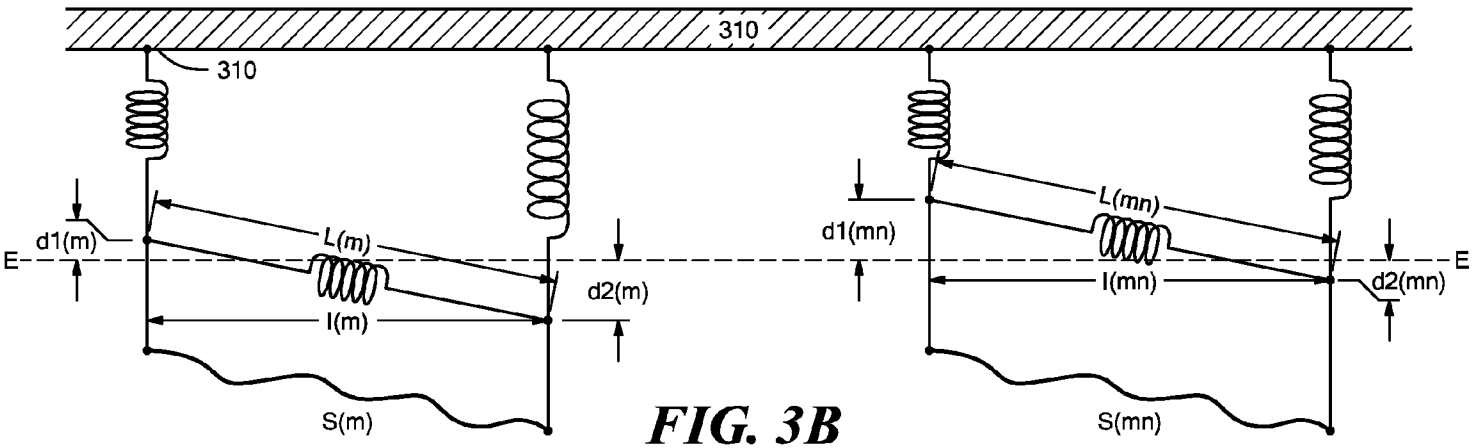

The coupled-spring model is shown in FIGS. 3A and 3B. FIG. 3A depicts a series of segments S(n) to be concatenated of respective durations (n) in time, with estimated endpoint $F_0$ values F01(n) and F02 (n) "attached" to the springs which tend to resist changes in the endpoints. The coupled-spring model includes three spring components for each speech segment. The first spring component couples the beginning fundamental frequency value F01(n) to an anchor component 310 (i.e., a fixed reference with respect to the segments), a second spring component couples the ending fundamental frequency value F02(n) to the anchor component, and a third spring component couples the beginning fundamental frequency value F01(n) to the ending fundamental frequency value F02(n). The constants of proportionality of the various spring components are indicated as k(n). These endpoint values are adjusted to be equal where the segments connect. d1(n) is the correction (or displacement) applied to F01(n), and d2(n) is the correction applied to F02(n), for all n segments in the utterance; n=1, . . . , N. $F_0$ values between the endpoints in each segment will have a correction value applied that is linearly interpolated between d1(n) and d2(n). Thus, the correction function will be a straight line with intercept and slope determined for each segment. The values for d1(n) and d2(n) are determined for the whole utterance by the coupling of springs as shown in FIG. 3B. At each segment endpoint, a vertically oriented spring resists change in $F_0$ with a spring constant k(n) which is proportional to the duration of voicing in the segment, so that long voiced segments will have a "stiffer" vertical spring than short, or less voiced segments.

$$k(n)=V_DUR(n)*KD,$$

where KD is the constant of proportionality. The forces which resist changes in $F_0$ will be denoted G, with $$Gv1(n)=k(n)*d1(n)$$

and $$Gv2(n)=k(n)*d2(n).$$

The horizontally-oriented springs in FIGS. 3A and 3B represent the non-linear restoring force that resists changes in slope. The displacements at the endpoints, d1(n) and d2(n), are constrained to be strictly vertical, so that any difference in the endpoint vertical displacements will result in a stretching of the horizontal spring. An effective length l(n), is assigned to each segment using the relation $$l(n)=DUR(n)*LD\ ,$$

where LD is the constant relating total segment duration in seconds to effective mechanical length for the purpose of the spring model. The length, L(n), of the "horizontal" spring will be greater than, or equal to l(n), depending on the difference in the endpoint displacements for the segment. Let $$D(n)=d2(n)-d1(n),$$

then, by simple geometry:

$$L(n)=\sqrt{D(n)^2+l(n)^2}.$$

The tension in the "horizontal" spring can be resolved into its horizontal and vertical components. We are only concerned with the vertical components, $$Gt1(n) = -KT * D(n) * \left\{1 - \frac{l(n)}{L(n)}\right\},$$

and $$Gt2(n)=-Gt1(n).$$

KT is the spring constant for all horizontal springs, and is identical for all segments. Finally, the total vertical forces on the segment endpoints are $$G1(n)=Gv1(n)+Gt1(n),$$

and $$G2(n)=Gv2(n)+Gt2(n).$$

For small changes in slope, Gt is small, but grows rapidly as the slope increases. For segments containing little or no voicing, Gv is small, but Gt remains in effect to couple, at least weakly, the $F_0$ values of segments on either side.

The coupling comes about by requiring that $$d2(n)-d1(n+1)=F01(n+1)-F02(n)$$

and $$G2(n)+G1(n+1)=0,$$

for all n; n=1, . . . N−1, segments in the utterance, except at the boundaries of the utterance, where $$G1(1)=0\ ,$$

and $$G2(N)=0\ .$$

The set of simultaneous non-linear equations is solved using an iterative algorithm. It is based on Newton's method of finding zeros of a function. Since the sum of forces at each junction must be made zero, the solution is approached by computing the derivatives of these sums with respect to the displacements at each junction, and using Newton's re-estimation formula to arrive at converging values for the displacements. As described herein, some segment endpoints were marked as unalterable because MAX_RATIO was exceeded across the boundary. The displacements of those endpoints will be held at zero. The iteration is carried out over all segments simultaneously, and continues until the absolute value of the ratio of (a) the sum of forces at each node to (b) their difference is a sufficiently small fraction. In one embodiment, the ratio should be less than or equal to 0.1 before the iteration stops, but other fractions may also be used to provide different performance. In practice, a typical utterance of 25 segments will require 10-20 iterations to converge. This does not represent a significant computational overhead in the context of TTS.

The model parameters used in one preferred embodiment are:

KD 1.0
KT 1.0
LD 1000.0

However, less preferred model parameters might fall in the ranges:

0.001<=KD<=10.0
0.001<=KT<=10.0
1.0<=LD<=10000.0 and these should not limit the scope of the invention as defined in the claims.

By adjusting these parameter values, it is possible to alter the behavior of the model to best suit the characteristics of a particular talker, speaking style or language. However, the values listed work well for a range of talkers, and languages. Increasing LD will make the onset of the highly non-linear term in the slope restoring force less abrupt. Increasing KD relative to KT will encourage slope change more, and overall segment offset less. Large values of KT relative to KD will encourage overall segment offset rather than slope change.

Once the coupled-spring equations have been solved, the displacements d1(n) and d2(n) may be used to correct the endpoint $F_0$ values. If the original $F_0$ values for the segment were F0(n,i), and each segment starts at time t0(n), and the frames occur at times t(n,i), then the $n^{th}$ segment's corrected $F_0$ values, given by F0'(n,i) for all M(n) frames i=1, . . . , M(n), are $$F0'(n, i) = F0(n, i) + d1(n) + \left\{ \left( d2(n) - d1(n) \right) * \frac{t(n, i) - t0(n)}{DUR(n)} \right\}.$$

If F0'(n,i) is less than MIN_F0 for any frame, then F0'(n,i) is set to MIN_F0. These corrections are only applied to voiced frames. Nothing is changed in the unvoiced frames. In FIG. 3B, these modified segments are labeled S'(n).

Various prior art methods exist for synthesizing the target utterance's waveform with the modified $F_0$ values. These include Pitch Synchronous Overlap and Add (PSOLA), Multi-band Resynthesis using Overlap and Add (MBROLA), sinusoidal waveform coding, harmonics+noise models, and various Linear Predictive Coding (LPC) methods, especially Residual Excited Linear Prediction (RELP). References to all of these are easily found in the speech coding and synthesis literature known to those in the art.

The invention may be embodied in other specific forms without departing from the scope of the invention as defined in the claims. The present embodiments are therefore to be considered in respects as illustrative and not restrictive, the scope of the invention being indicated by the appended claims rather than by the foregoing description, and all changes which come within the meaning and range of the equivalency of the claims are therefore intended to be embraced therein. While some claims use the term "linear function" in the context of this invention, a substantially linear function or a non-linear function capable of having the desired effect would be adequate. Therefore the claims should not be interpreted on their strict literal meaning.

What is claimed is:

1. A method of smoothing fundamental frequency discontinuities at boundaries of concatenated speech segments, each speech segment characterized by a segment fundamental frequency contour and including two or more frames, comprising:

determining, for each speech segment, a beginning fundamental frequency value and an ending fundamental frequency value;

adjusting the fundamental frequency contour of each of the speech segments according to a predetermined function calculated for each particular speech segment according to a coupled spring model, wherein parameters characterizing each predetermined function are selected according to the beginning fundamental frequency value and the ending fundamental frequency value of the corresponding speech segment.

2. A method according to claim 1, wherein the predetermined function adjusts a slope associated with the speech segment.

3. A method according to claim 1, wherein the predetermined function adjusts an offset associated with the speech segment.

4. A method according to claim 1, wherein the predetermined function includes a linear function.

5. A method according to claim 1, wherein the predetermined function calculated for each particular speech segment is dependent upon a length associated with the speech segment, such that the predetermined function adjusts longer segments more than shorter segments.

6. A method according to claim 1, further including determining, for each speech segment one or more parameters selected from: (i) a total duration of the segment; (ii) a total duration of all voiced regions of the segment; (iii) a average value of the fundamental frequency contour over all voiced regions of the segment; (iv) a median value of the fundamental frequency contour over all voiced regions of the segment; and (v) a standard deviation of the fundamental frequency contour over the whole segment.

7. A method according to claim 6, further including setting the determined median value of the fundamental frequency contour over all voiced regions of the segment to the average value of the fundamental frequency contour over all voiced regions of the segment if a number of fundamental frequency samples in the speech segment is less than a predetermined value.

8. A method according to claim 1, further including examining a predetermined number of frames from a beginning point of each speech segment, and setting the beginning fundamental frequency value to a fundamental frequency value of the first frame if all fundamental frequency values of the predetermined number of frames from the beginning point of the speech segment are within a predetermined range.

9. A method according claim 1, further including examining a predetermined number of frames from an ending point of each speech segment, and setting the ending fundamental frequency value to a fundamental frequency value of the last frame if all fundamental frequency values of the predetermined number of frames from the ending point of the speech segment are within a predetermined range.

10. A method according to claim 1, further including setting the beginning fundamental frequency and the ending fundamental frequency of unvoiced speech segments to a value substantially equal to a median value of the fundamental frequency contour over all voiced regions of a preceding voiced segment.

11. A method according to claim 1, further including calculating, for each pair of adjacent speech segments n and n+1one or more of: (i) a first ratio of the nth ending fundamental frequency value to the n+1th beginning fundamental frequency value; and (ii) a second ratio being the inverse of the first ratio; and adjusting the nth ending fundamental frequency value and the n+1th beginning fundamental frequency value only if the first ratio and/or the second ratio are less than a predetermined ratio threshold.

12. A method according to claim 1, further including implementing the coupled spring model such that a first spring component couples the beginning fundamental frequency value to an anchor component, a second spring component couples the ending fundamental frequency value to the anchor component, and a third spring component couples the beginning fundamental frequency value to the ending fundamental frequency value.

13. A method according to claim 12, further including associating a spring constant with the first spring and the second spring such that the spring constant is proportional to a duration of voicing in the associated speech segment.

14. A method according to claim 12, further including associating a spring constant with the third spring such that the third spring models a non-linear restoring force that resists a change in slope of the segment fundamental frequency contour.

15. A method according to claim 1, further including forming a set of simultaneous equations corresponding to the coupled spring models associated with all of the concatenated speech segments, and solving the set of simultaneous equations to produce the parameters characterizing each linear function associated with one of the speech segments.

16. A method according to claim 15, further including solving the set of simultaneous equations through an iterative algorithm based on Newton's method of finding zeros of a function.

17. A system for smoothing fundamental frequency discontinuities at boundaries of concatenated speech segments, each speech segment characterized by a segment fundamental frequency contour and including two or more frames, comprising:

a unit characterization processor for receiving the speech segments and characterizing each segment with respect to a beginning fundamental frequency and an ending fundamental frequency;

a fundamental frequency adjustment processor for receiving the speech segments, the beginning fundamental frequency and ending fundamental frequency, and for adjusting the fundamental frequency contour of each of the speech segments according to a predetermined function calculated for each particular speech segment according to a coupled spring model, wherein parameters characterizing each predetermined function are selected according to the beginning fundamental frequency value and the ending fundamental frequency value of the corresponding speech segment.

18. A system according to claim 17, wherein the predetermined function adjusts a slope associated with the speech segment.

19. A system according to claim 17, wherein the predetermined function adjusts an offset associated with the speech segment.

20. A system according to claim 17, wherein the predetermined function includes a linear function.

21. A system according to claim 17, wherein the predetermined function calculated for each particular speech segment is dependent upon a length associated with the speech segment, such that the predetermined function adjusts longer segments more than shorter segments.

22. A system according to claim 17, wherein the unit characterization processor determines, for each speech segment one or more of: (i) a total duration of the segment; (ii) a total duration of all voiced regions of the segment; (iii) an average value of the fundamental frequency contour over all voiced regions of the segment; (iv) a median value of the fundamental frequency contour over all voiced regions of the segment; and (v) a standard deviation of the fundamental frequency contour over the whole segment.

23. A system according to claim 22, wherein the unit characterization processor sets the determined median value of the fundamental frequency contour over all voiced regions of the segment to the average value of the fundamental frequency contour over all voiced regions of the segment if a number of fundamental frequency samples in the speech segment is less than a predetermined value.

24. A system according to claim 17, wherein the unit characterization processor examines a predetermined number of frames from a beginning point of each speech segment, and sets the beginning fundamental frequency value to a fundamental frequency value of the first frame if all fundamental frequency values of the predetermined number of frames from the beginning point of the speech segment are within a predetermined range.

25. A system according to claim 17, wherein the unit characterization processor examines a predetermined number of frames from a ending point of each speech segment, and sets the ending fundamental frequency value to a fundamental frequency value of the last frame if all fundamental frequency values of the predetermined number of frames from the ending point of the speech segment are within a predetermined range.

26. A system according to claim 17, wherein the unit characterization processor sets the beginning fundamental frequency and the ending fundamental frequency of unvoiced speech segments to a value substantially equal to a median value of the fundamental frequency contour over all voiced regions of a preceding voiced segment.

27. A system according to claim 17, wherein the unit characterization processor calculates, for each pair of adjacent speech segments n and n+1 one or more of: (i) a first ratio of the nth ending fundamental frequency value to the n+1 beginning fundamental frequency value; and (ii) a second ratio being the inverse of the first ratio, and adjusts the nth ending fundamental frequency value and the n+1th beginning fundamental frequency value only if the first ratio and/or the second ratio are less than a predetermined ratio threshold.

28. A system according to claim 17, wherein the fundamental frequency adjustment processor implements the coupled spring model such that a first spring component couples the beginning fundamental frequency value to an anchor component, a second spring component couples the ending fundamental frequency value to the anchor component, and a third spring component couples the beginning fundamental frequency value to the ending fundamental frequency value.

29. A system according to claim 28, wherein the fundamental frequency adjustment processor associates a spring constant with the first spring and the second spring such that the spring constant is proportional to a duration of voicing in the associated speech segment.

30. A system according to claim 28, wherein the fundamental frequency adjustment processor associates a spring constant with the third spring such that the third spring models a non-linear restoring force that resists a change in slope of the segment fundamental frequency contour.

31. A system according to claim 17, wherein the fundamental frequency adjustment processor forms a set of simultaneous equations corresponding to the coupled spring models associated with all of the concatenated speech segments, and solves the set of simultaneous equations to produce the parameters characterizing each linear function associated with one of the speech segments.

32. A system according to claim 31, wherein the fundamental frequency adjustment processor solves the set of simultaneous equations through an iterative algorithm based on Newton's method of finding zeros of a function.

* * * * *